US010613456B2

(12) United States Patent
Soshi

(10) Patent No.: US 10,613,456 B2
(45) Date of Patent: Apr. 7, 2020

(54) GUIDE MEMBER DOWNSTREAM OF A FIXING DEVICE AND IMAGE FORMING APPARATUS HAVING THE SAME

(71) Applicant: FUJI XEROX CO., LTD., Tokyo (JP)

(72) Inventor: Kyogo Soshi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/162,638

(22) Filed: Oct. 17, 2018

(65) Prior Publication Data

US 2019/0219955 A1 Jul. 18, 2019

(30) Foreign Application Priority Data

Jan. 12, 2018 (JP) ..... 2018-003568

(51) Int. Cl.
*G03G 15/20* (2006.01)
*G03G 15/00* (2006.01)

(52) U.S. Cl.
CPC ..... *G03G 15/2028* (2013.01); *G03G 15/6573* (2013.01); *G03G 2215/00417* (2013.01)

(58) Field of Classification Search
CPC ..... G03G 15/2028; G03G 15/6573; G03G 2215/00417; G03G 2215/00421; G03G 2215/0043
See application file for complete search history.

(56) References Cited

U.S. PATENT DOCUMENTS 3,955,916 A * 5/1976 Bar-on ..... B65H 29/54 432/60
4,062,534 A * 12/1977 Sasahara ..... G03G 15/2028 118/245
4,420,152 A * 12/1983 Miyashita ..... B65H 29/56 271/309
7,062,211 B2 * 6/2006 Baba ..... G03G 15/2028 399/323
7,684,744 B2 3/2010 Uchida
8,145,109 B2 * 3/2012 Ishikawa ..... G03G 15/2028 399/323
2008/0101829 A1 * 5/2008 Kim ..... G03G 15/206 399/331
2014/0169819 A1 * 6/2014 Katakura ..... G03G 15/2053 399/69

FOREIGN PATENT DOCUMENTS

JP 2007-322590 A 12/2007

* cited by examiner

*Primary Examiner* — David M. Gray
*Assistant Examiner* — Laura Roth
(74) *Attorney, Agent, or Firm* — Sughrue Mion, PLLC

(57) ABSTRACT

A fixing device includes a heating member, a pressing member, and a guide portion. The heating member heats a toner image and includes an elastic body. The pressing member presses a recording medium against the heating member. The guide portion does not contact with the heating member, and guides the recording medium ejected from a nip of the heating member and the pressing member. The distance from an exit of the contact portion to an end portion of the guide portion adjacent the contact portion differs in accordance with the position in the longitudinal direction of the heating member. The distance at a position at which the pressure between the heating member and the pressing member is low is longer than the distance at a position at which the pressure between the heating member and the pressing member is high.

13 Claims, 8 Drawing Sheets

GUIDE MEMBER DOWNSTREAM OF A FIXING DEVICE AND IMAGE FORMING APPARATUS HAVING THE SAME

CROSS-REFERENCE TO RELATED APPLICATIONS

This application is based on and claims priority under 35 USC 119 from Japanese Patent Application No. 2018-003568 filed Jan. 12, 2018.

BACKGROUND

(i) Technical Field

The present disclosure relates to a fixing device and an image forming apparatus.

(ii) Related Art

Japanese Unexamined Patent Application Publication No. 2007-322590 describes a fixing device that fixes a toner image, which has been transferred to paper, to the paper by heating. The fixing device includes a fixing roller, a pressurizing roller, and a plurality of separation lugs. The fixing roller heats the toner image. The pressurizing roller is pressed into contact with the fixing roller to form a nip part together with the fixing roller so that the toner image is fixed to the paper at the nip part. The plurality of separation lugs are disposed in parallel along the axis of the fixing roller in a paper passage region of the fixing roller on the downstream side with respect to the nip part in the transport direction of the paper to separate the paper from the fixing roller. The plurality of separation lugs each include a distal end lug portion that contacts the peripheral surface of the fixing roller, and are disposed such that the spacing from the distal end lug portion of the separation lug positioned in the vicinity of at least one end portion of the paper passage region to the nip part is smaller than the spacing from the distal end lug portion of the separation lug not positioned in the vicinity of the end portion to the nip part.

SUMMARY

In the fixing device, a recording medium ejected from a contact portion at which a heating member and a pressing member contact each other may adhere to the heating member, and the recording medium may not be peeled from the heating member.

Aspects of non-limiting embodiments of the present disclosure relate to a fixing device and an image forming apparatus that allow a recording medium to be easily peeled from a heating member compared to a case where the distance from an exit of a contact portion to an end portion of a guide portion on the side of the exit of the contact portion is constant at different positions in the longitudinal direction of the heating member.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a fixing device including: a heating member that heats a toner image, at least a surface of the heating member including an elastic body; a pressing member that presses a recording medium against the heating member; and a guide portion that is in no contact with the heating member and that guides the recording medium, which has been ejected from a contact portion at which the heating member and the pressing member contact each other, toward a downstream side in a moving direction of the recording medium, in which a distance from an exit of the contact portion to an end portion of the guide portion on a side of the exit of the contact portion differs in accordance with a position in a longitudinal direction of the heating member, and the distance at a position at which a pressure between the heating member and the pressing member is low is longer than the distance at a position at which the pressure between the heating member and the pressing member is high.

BRIEF DESCRIPTION OF THE DRAWINGS

An exemplary embodiment of the present disclosure will be described in detail based on the following figures, wherein.

DETAILED DESCRIPTION

Figure 1:
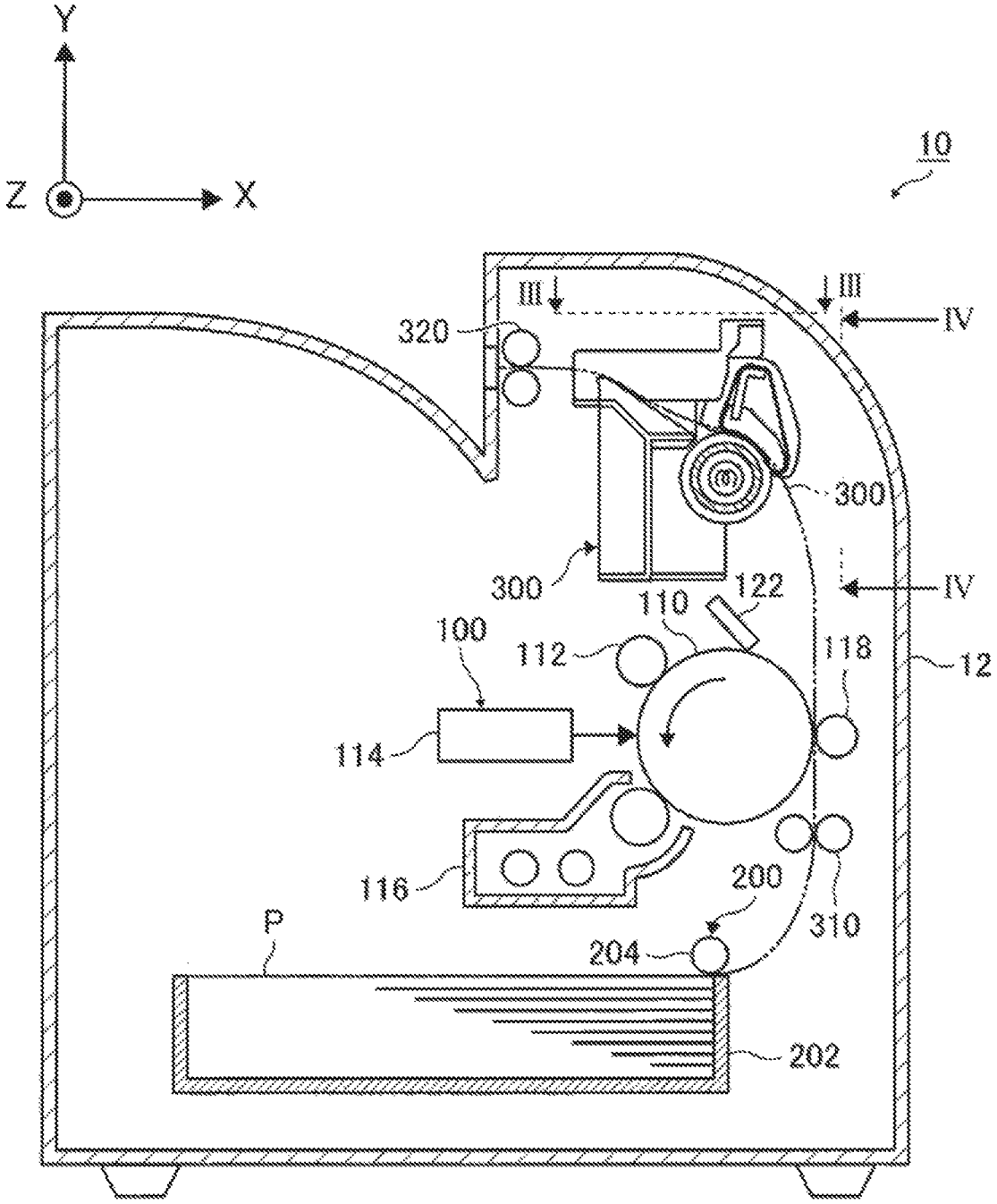
FIG. 1 is a sectional view illustrating an image forming apparatus used in an exemplary embodiment of the present disclosure.

Now, an exemplary embodiment of the present disclosure will be described with reference to the drawings. FIG. 1 is a sectional view illustrating an image forming apparatus used in an exemplary embodiment of the present disclosure as seen from the front side. An image forming apparatus 10 includes an image forming apparatus body 12. A toner image forming portion 100, a supply device 200, and a fixing device 400 are disposed in the image forming apparatus body 12. A transport path 300 is also disposed in the image forming apparatus body 12.

The toner image forming portion 100 forms a toner image on a surface of a recording medium P such as paper, for example. The toner image forming portion 100 includes a photosensitive drum 110, a charging device 112, a latent image forming device 114, a developing device 116, a transfer device 118, and a cleaning device 122. The photosensitive drum 110 is an example of an image holding member. The charging device 112 charges a surface of the photosensitive drum 110. The latent image forming device 114 forms a latent image on the surface of the photosensitive drum 110 which has been charged by the charging device 112. The developing device 116 develops the latent image, which has been formed by the latent image forming device 114, using a toner to form a toner image. The transfer device 118 transfers the toner image, which has been developed by the developing device 116, to the recording medium P. The cleaning device 122 cleans the surface of the photosensitive drum 110.

The supply device 200 includes a housing portion 202 and a feeder device 204. The recording medium P is housed in the housing portion 202. The recording medium P which is housed in the housing portion 202 is fed by the feeder device 204 to be supplied to the toner image forming portion 100.

The transport path 300 transports the recording medium P from the supply device 200 to the toner image forming portion 100, transports the recording medium P, on which a toner image has been formed by the toner image forming portion 100, to the transfer device 400, and further transports the recording medium P, to which the toner image has been fixed by the fixing device 400, to the outside of the image forming apparatus body 12. The feeder device 204 discussed earlier, a resist roller 310, the fixing device 400 discussed earlier, and an ejection roller 320 are disposed along the transport path 300, in this order from the upstream side in the transport direction of the recording medium P.

The resist roller 310 temporarily stops movement of the distal end portion of the recording medium P which has been transported from the upstream side, and resumes movement of the distal end of the recording medium P so as to match the timing when the toner image forming portion 100 forms a toner image.

The ejection roller 320 is an example of a transport member. The ejection roller 320 is disposed on the downstream side with respect to a guide portion 450 to be discussed later in the transport direction of the recording medium P, and transports and ejects the recording medium P, which has been guided by the guide portion 450, to the outside of the image forming apparatus body 12.

The fixing device 400 fixes the toner image, which has been formed by the toner image forming portion 100 and transferred to the recording medium P, to the recording medium P using heat and a pressure, for example. The fixing device 400 will be discussed in detail later.

Figure 2:
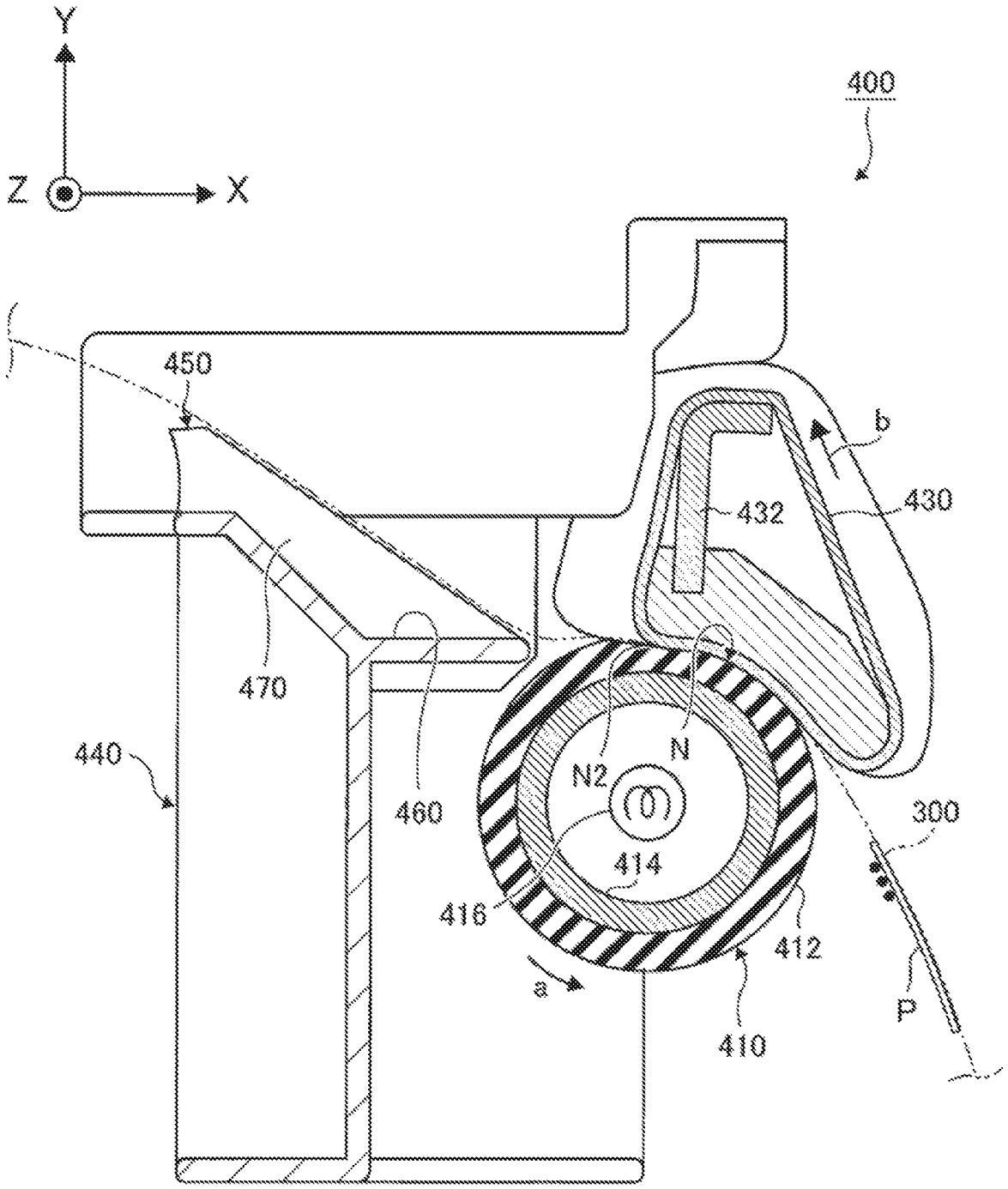
FIG. 2 is a view illustrating a sectional surface of a fixing device of the image forming apparatus illustrated in FIG. 1 as seen from the front side.
Figure 3:
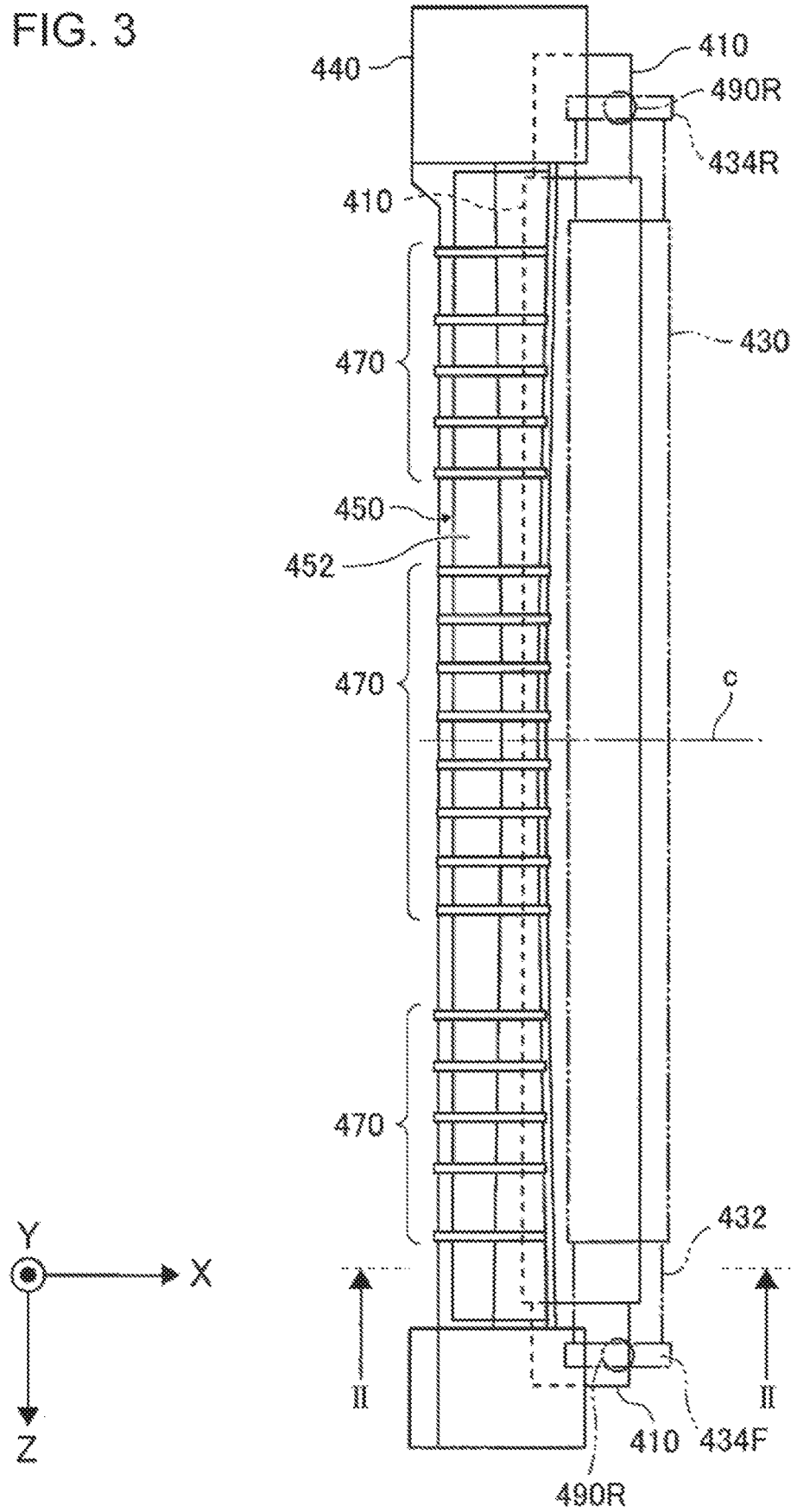
FIG. 3 illustrates the fixing device illustrated in FIG. 2 as seen from the side of the arrow III-III in FIG. 1.

FIG. 2 is a sectional view illustrating the fixing device 400 as seen from the front side, illustrating a sectional surface taken along the line II-II in FIG. 3. As illustrated in FIG. 2, the fixing device 400 includes a heating roller 410. The heating roller 410 is an example of a heating member. At least a surface of the heating roller 410 includes an elastic body 412. The heating roller 410 applies heat to the toner image which has been transferred to the recording medium P. The heating roller 410 is coupled to a drive device (not illustrated), and rotated in the direction of the arrow a indicated in FIG. 2 when driven by the drive device. The heating roller 410 further includes a hollow core metal 414. A surface of the core metal 414 is covered by the elastic body 412. A heat source 416 is disposed in the hollow portion of the core metal 414.

Silicone rubber which has heat resistance, for example, may be used as the material of the elastic body 412. A halogen lamp, for example, may be used as the heat source 416.

The fixing device 400 further includes a belt member 430. The belt member 430 is an example of a pressing member. The belt member 430 presses the recording medium P against the heating roller 410. The belt member 430 has an endless belt shape, for example, and is rotatably supported by a support portion 432. The belt member 430 is rotated in the direction of the arrow b indicated in FIG. 2 so as to follow motion of the heating roller 410, for example.

A roller (not illustrated), for example, may be used as the pressing member instead of using the belt member 430 as the pressing member. Alternatively, a so-called pressurizing pad (not illustrated) may be used as the pressing member instead of using the belt member 430 as the pressing member.

A side plate 434R is mounted to the rear end portion of the support portion 432. A side plate 434F (not illustrated in FIG. 3; see FIGS. 4 and 5) is mounted to the front end portion of the support portion 432.

In the fixing device 400 configured as described above, the recording medium P and the toner image, which has been transferred to the recording medium P, are heated in a contact portion N, at which the heating roller 410 and the belt member 430 contact each other, so that the toner image is fixed to the recording medium P by heat and a pressure.

A portion of the support portion 432 that contacts the heating roller 410 via the belt member 430 is formed from a material that is harder than the elastic body 412 and that is less deformable than the elastic body 412. Therefore, when at least one of the heating roller 410 and the belt member 430 is urged in the direction in which the heating roller 410 and the belt member 430 approach each other, the elastic body 412 is elastically deformed so as to be recessed toward the center side. Since the elastic body 412 is deformed so as to be recessed, a force that curves the recording medium P is applied to the recording medium P, which is ejected from the contact portion N, at an exit N2 of the contact portion N. The recording medium P is separated from the heating roller 410 because of the rigidity (firmness) of the recording medium P which is curved by the force which is applied thereto.

The force which is applied to the recording medium P may differ among positions in the longitudinal direction of the heating roller 410, and the curve which is caused in and the rigidity of the recording medium P may not be constant among positions in the longitudinal direction of the heating roller 410. In addition, both the curve which is caused in the recording medium P and the rigidity of the recording medium P are variable under the influence of the thickness and the material of the recording medium P, the humidity and the temperature in the image forming apparatus body 12, etc., for example. Therefore, in the fixing device 400, the recording medium P may be caught around the heating roller 410 with all or a part of the recording medium P not peeled from the heating roller 410.

The fixing device 400 further includes a housing 440. The housing 440 is an example of a structure. The housing 440 rotatably supports the heating roller 410 using a support mechanism (not illustrated) such as a bearing, for example.

The fixing device 400 further includes the guide portion 450. The guide portion 450 guides the recording medium P, which has been ejected from the contact portion N, toward the downstream side in the transport direction of the recording medium P. In the exemplary embodiment, the guide portion 450 is constituted as a part of the housing 440. That is, in the exemplary embodiment, the guide portion 450 is integral with the housing 440 which is a member that supports the heating roller 410.

The guide portion 450 may be separate from the housing 440, rather than being integral with the housing 440. In the case where the guide portion 450 and the housing 440 are separate from each other, the guide portion 450 is mounted to the image forming apparatus body 12, for example.

The guide portion 450 is not in contact with the heating roller 410. In this respect, the guide portion 450 is different from a separation member such as a separation lug, for example, that contacts a surface of the heating roller 410 to separate the recording medium P from the surface of the heating roller 410.

The guide portion 450 includes a plate-like portion 460. The right end portion of the plate-like portion 460 is positioned in the vicinity of the heating roller 410. The right end portion side of the plate-like portion 460 is curved such that the center c (see FIGS. 3 and 4) side, in the longitudinal direction of the belt member 430 etc., of the right end portion side of the plate-like portion 460 is positioned on the left side and the end portion side, in the longitudinal direction of the belt member 430 etc., of the right end portion side of the plate-like portion 460 is positioned on the right side (see FIG. 3). The center c side, in the longitudinal direction of the heating roller 410 etc., of the plate-like portion 460 is positioned on the lower side, and the end portion side, in the longitudinal direction of the heating roller 410 etc., of the plate-like portion 460 is positioned on the upper side (see FIG. 4).

Figure 4:
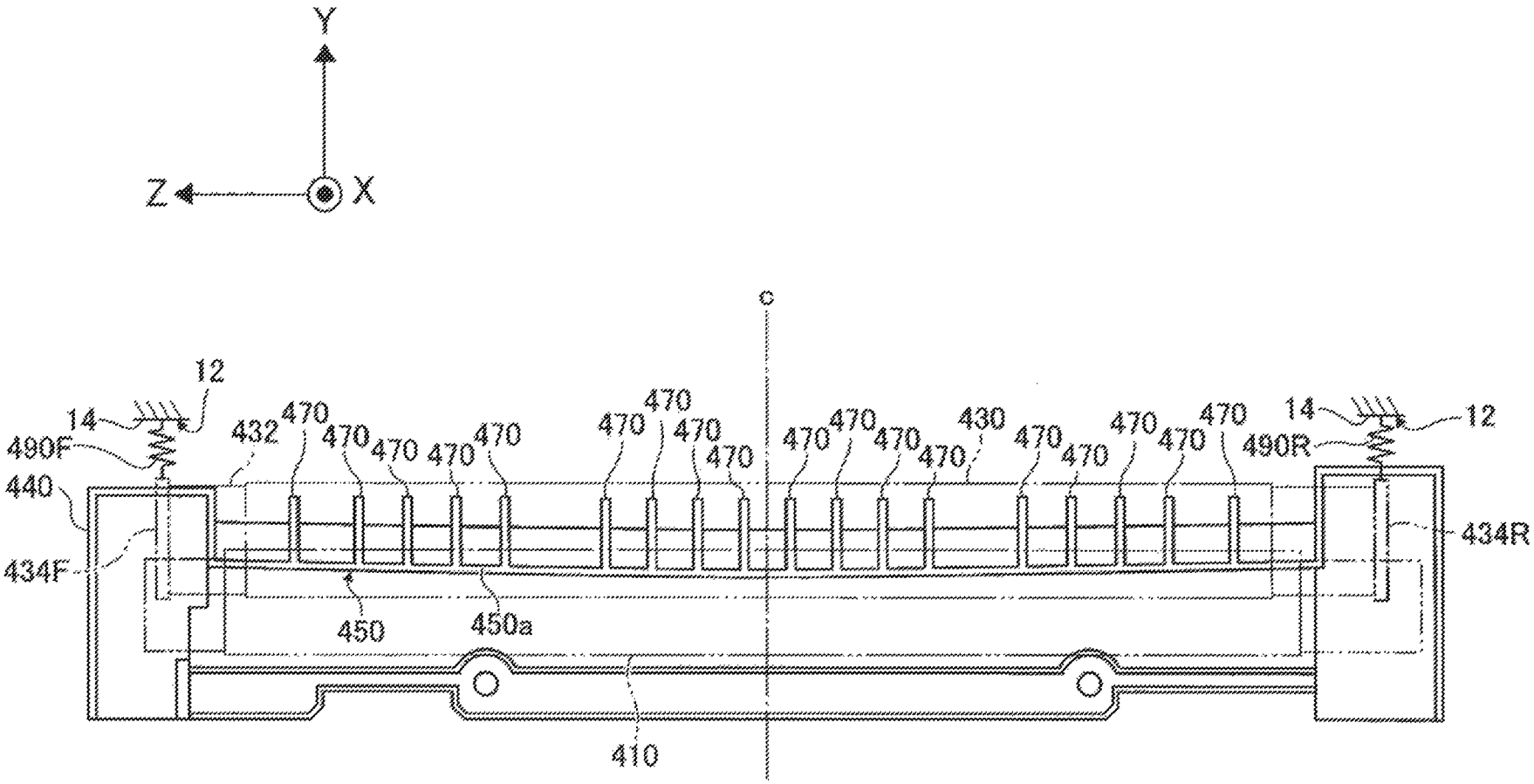
FIG. 4 illustrates the fixing device illustrated in FIG. 2 as seen from the side of the arrow IV-IV in FIG. 1.

The guide portion 450 further includes a plurality of (e.g. eighteen) rib portions 470 (also see FIGS. 3 and 4). The rib portions 470 are attached to the plate-like portion 460 so as to extend vertically. The rib portions 470 reinforce the plate-like portion 460, and the upper end portions of the rib portions 470 guide the recording medium P.

FIG. 3 illustrates the fixing device 400 as seen from the direction of the arrow III-III in FIG. 1, and is a plan view of the fixing device 400. In FIG. 3, for convenience of illustration, the belt member 430 is indicated by the phantom line (double-dashed line). FIG. 4 illustrates the fixing device 400 as seen from the direction of the arrow IV-IV in FIG. 1, and is a right side view of the fixing device 400. In FIG. 4, for convenience of illustration, the heating roller 410 is indicated by the phantom line (double-dashed line) in addition to the belt member 430.

As illustrated in FIGS. 3 and 4, the fixing device 400 further includes a coil spring 490F and a coil spring 490R. The coil spring 490F and the coil spring 490R are each an example of an urging mechanism, and urge the belt member 430 in the direction in which the heating roller 410 and the belt member 430 approach each other. The upper end portion of the coil spring 490F is fixed to a body frame 14 that constitutes a part of the image forming apparatus body 12. The lower end portion of the coil spring 490F is in contact with the side plate 434F. The upper end portion of the coil spring 490R is fixed to the body frame 14. The lower end portion of the coil spring 490R is in contact with the side plate 434R.

With the configuration described above, the coil spring 490F and the coil spring 490R urge the side plate 434F, the side plate 434R, the support portion 432, and the belt member 430 integrally toward the heating roller 410, and presses the belt member 430 against the heating roller 410.

The coil spring 490F is disposed on the front side in the longitudinal direction of the heating roller 410 and the belt member 430 (hereinafter referred to as the "longitudinal direction of the heating roller 410 etc."). The coil spring 490R is disposed on the rear side in the longitudinal direction of the heating roller 410 etc. That is, the coil spring 490F and the coil spring 490R are each disposed on the side of an end portion in the longitudinal direction of the heating roller 410 etc.

In the exemplary embodiment, as described above, the coil spring 490F and the coil spring 490R are each disposed on the side of an end portion in the longitudinal direction of the heating roller 410 etc., and therefore the pressure between the heating roller 410 and the belt member 430 has different values in accordance with the position in the longitudinal direction of the heating roller 410 etc. Specifically, the pressure between the heating roller 410 and the belt member 430 is higher on the side of an end portion in the longitudinal direction of the heating roller 410 etc., and lower on the side of the center c.

In the exemplary embodiment, the coil spring 490F and the coil spring 490R, which are each an example of the urging mechanism, urge the belt member 430 in the direction in which the heating roller 410 and the belt member 430 approach each other. However, the urging mechanism may urge at least one of the heating roller 410 and the belt member 430 in the direction in which the heating roller 410 and the belt member 430 approach each other. That is, the urging mechanism may be a mechanism that urges the heating roller 410 in the direction in which the heating roller 410 and the belt member 430 approach each other, or may be a mechanism that urges both the heating roller 410 and the belt member 430 in the direction in which the heating roller 410 and the belt member 430 approach each other.

Figure 5:
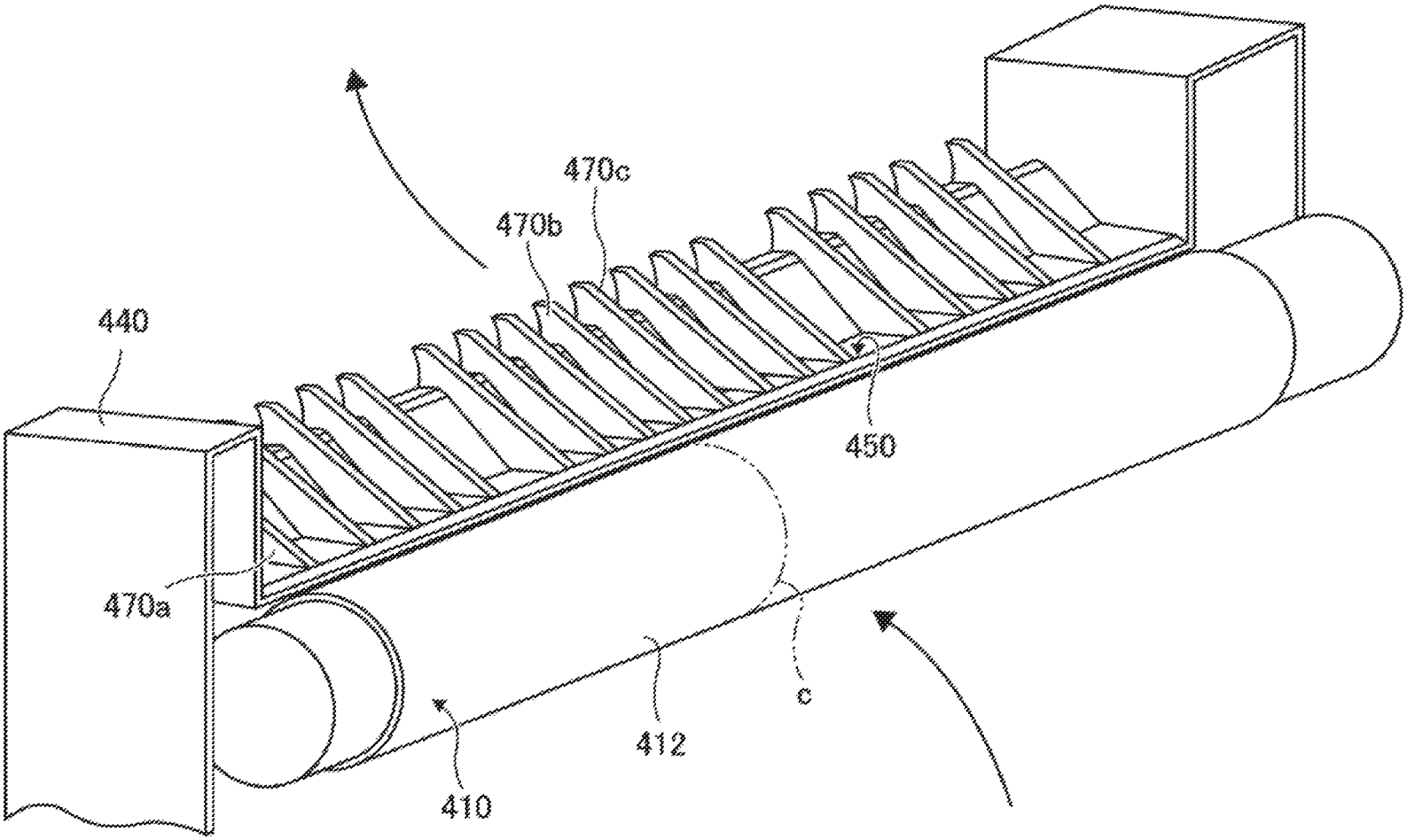
FIG. 5 is a first view illustrating the positional relationship between a heating roller and a guide portion of the fixing device illustrated in FIGS. 3 and 4, and is a perspective view illustrating the heating roller and the guide portion.

FIG. 5 is a first view illustrating the positional relationship between the heating roller 410 and the guide portion 450, and is a perspective view illustrating the heating roller 410 and the guide portion 450. As illustrated in FIG. 5, the guide portion 450 is disposed on the downstream side with respect to the heating roller 410 in the transport direction of the recording medium P indicated by the arrows in FIG. 5, and guides the recording medium P, which has been ejected from the contact portion N (see FIG. 2, for example), toward the downstream side in the transport direction of the recording medium P.

As illustrated in FIG. 5, of the eighteen rib portions 470, the forefront rib portion 470 is defined as a rib portion 470*a*, the ninth rib portion 470 from the front side is defined as a rib portion 470*b*, and the tenth rib portion 470 from the front side is defined as a rib portion 470*c*. The positional relationship between the heating roller 410 and the guide portion 450 is determined such that the center c of the heating roller 410 in the longitudinal direction of the heating roller 410 is located between the rib portion 470*b* and the rib portion 470*c* and is equidistant from the rib portion 470*b* and the rib portion 470*c*.

Also for the belt member 430, as for the heating roller 410, the positional relationship between the belt member 430 and the guide portion 450 is also determined such that the center c of the belt member 430 in the longitudinal direction of the belt member 430 is positioned between the rib portion 470*b* and the rib portion 470*c* and is equidistant from the rib portion 470*b* and the rib portion 470*c*.

Figure 6:
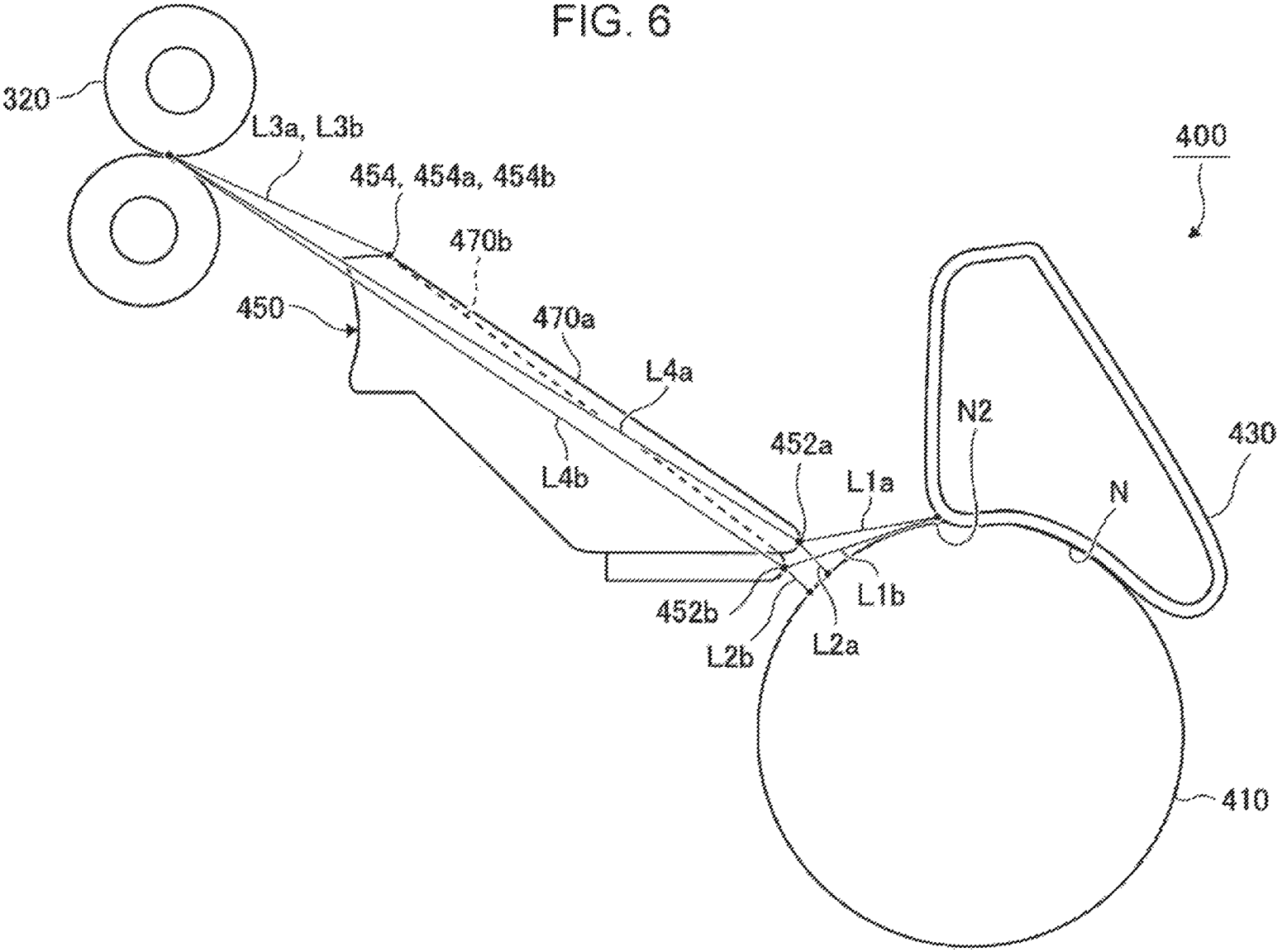
FIG. 6 is a second view illustrating the positional relationship between the heating roller and the guide portion of the fixing device illustrated in FIGS. 3 and 4, and schematically illustrates the heating roller and the guide portion.

FIG. 6 is a second view illustrating the positional relationship between the heating roller 410 and the guide portion 450, and schematically illustrates the heating roller 410 and the guide portion 450. In FIG. 6, of the eighteen rib portions 470, the rib portions 470 other than the rib portion 470*a* and the rib portion 470*b* are not illustrated.

In the following description, as illustrated in FIG. 6, an end portion of the guide portion 450 on the right side is defined as a distal end portion 452, the distal end portion 452 at the position of the rib portion 470*a* in the longitudinal direction of the guide portion 450 is defined as a distal end portion 452*a*, and the distal end portion 452 at the position of the rib portion 470*b* in the longitudinal direction of the guide portion 450 is defined as a distal end portion 452*b*. The distal end portion 452 is an end portion of the guide portion 450 on the side of the exit N2 of the contact portion N.

As illustrated in FIG. 6, the distance from the exit N2 of the contact portion N to the distal end portion 452 of the guide portion 450 is defined as a distance L1, the distance L1 at the position of the rib portion 470*a* in the longitudinal direction of the guide portion 450 is defined as a distance L1*a*, and the distance L1 at the position of the rib portion 470*b* in the longitudinal direction of the guide portion 450 is defined as a distance L1*b*. When the distance L1*a* and the distance L1*b* are compared with each other, the distance L1*a* and the distance L1*b* are different from each other, and the distance L1*b* is longer than the distance L1*a*.

That is, in the exemplary embodiment, the distance L1 from the exit N2 of the contact portion N to an end portion of the guide portion 450 on the exit N2 side differs in accordance with the position in the longitudinal direction of the heating roller 410, and the distance L1 at a position that is close to the center c (see FIGS. 4 and 5) of the heating roller 410 in the longitudinal direction of the heating roller 410 is longer than the distance L1 at a position that is far from the center c of the heating roller 410 in the longitudinal direction of the heating roller 410.

In the exemplary embodiment, as discussed earlier, the pressure between the heating roller 410 and the belt member 430 is higher at a position that is close to the center c in the longitudinal direction of the heating roller 410 and the belt member 430, and is lower at a position that is far from the center c in the longitudinal direction of the heating roller 410 and the belt member 430. Therefore, in the exemplary embodiment, the distance L1 from the exit N2 of the contact portion N to the exit N2 side of the guide portion 450 is made different in accordance with the position in the longitudinal direction of the heating roller 410 such that the distance L1 at a position at which the pressure between the heating roller 410 and the belt member 430 is low is longer than the distance L1 at a position at which the pressure between the heating roller 410 and the belt member 430 is high.

That is, in the fixing device 400, the distance L1 at a portion of the recording medium P, in the longitudinal direction of the heating roller 410 etc., to which a low pressure is applied from the heating roller 410 and the belt member 430, at which the rigidity of the recording medium P is low, and at which the recording medium P is not easily peeled from the heating roller 410 is longer than the distance L1 at a portion of the recording medium P to which a high pressure is applied from the heating roller 410 and the belt member 430, at which the rigidity of the recording medium P is high, and at which the recording medium P is easily peeled from the heating roller 410.

As illustrated in FIG. 6, the distance from the distal end portion 452 of the guide portion 450 to the surface of the heating roller 410 is defined as a distance L2, the distance L2 at the position of the rib portion 470*a* in the longitudinal direction of the guide portion 450 is defined as a distance L2*a*, and the distance L2 at the position of the rib portion 470*b* in the longitudinal direction of the guide portion 450 is defined as a distance L2*b*. The distance from the distal end portion 452 to a surface of the heating roller 410 indicates the length of a perpendicular line drawn from the distal end portion 452 to a surface of the heating roller 410.

As illustrated in FIG. 6, the difference between the distance L2*a* and the distance L2*b* is smaller than the difference between the distance L1*a* and the distance L1*b*. That is, in the fixing device 400, the difference in the distance L2 from the distal end portion 452, which is an end portion of the guide portion 450 on the side of the exit N2 of the contact portion N, to a surface of the heating roller 410 among positions in the longitudinal direction of the heating roller 410 is smaller than the difference in the distance L1 from the exit N2 of the contact portion N to the distal end portion 452 among positions in the longitudinal direction of the heating roller 410.

The distance L2 may be constant irrespective of the position in the longitudinal direction of the heating roller 410.

As illustrated in FIG. 6, an end portion of the guide portion 450 on the left side is defined as a rear end portion 454, the rear end portion 454 at the position of the rib portion 470*a* in the longitudinal direction of the guide portion 454 is defined as a rear end portion 454*a*, and the rear end portion 454 at the position of the rib portion 470*b* in the longitudinal direction of the guide portion 450 is defined as a rear end portion 454*b*. The rear end portion 454 is an end portion of the guide portion 450 on the side of the ejection roller 320.

As illustrated in FIG. 6, the distance from the rear end portion 454 of the guide portion 450 to the ejection roller 320 is defined as a distance L3, the distance L3 at the position of the rib portion 470*a* in the longitudinal direction of the guide portion 450 is defined as a distance L3*a*, and the distance L3 at the position of the rib portion 470*b* in the longitudinal direction of the guide portion 450 is defined as a distance L3*b*. As illustrated in FIG. 6, the distance from the distal end portion 452 of the guide portion 450 to the ejection roller 320 is defined as a distance L4, the distance L4 at the position of the rib portion 470*a* in the longitudinal direction of the guide portion 450 is defined as a distance L4*a*, and the distance L4 at the position of the rib portion 470*b* in the longitudinal direction of the guide portion 450 is defined as a distance L4*b*. The distal end portion 452 is an end portion of the guide portion 450 on the side opposite to the ejection roller 320.

The distance L3*a*, the distance L3*b*, the distance L4*a*, and the distance L4*b* are determined such that the difference between the distance L3*a* and the distance L3*b* is smaller than the difference between the distance L4*a* and the distance L4*b*. That is, in the exemplary embodiment, the difference in the distance L3 from the rear end portion 454 of the guide portion 450 to the ejection roller 320 among positions in the longitudinal direction of the heating roller 410 is smaller than the difference in the distance L4 from the distal end portion 452 to the ejection roller 320 among positions in the longitudinal direction of the heating roller 410.

The distance L3 may be constant irrespective of the position in the longitudinal direction of the heating roller 410 etc.

Figure 7:
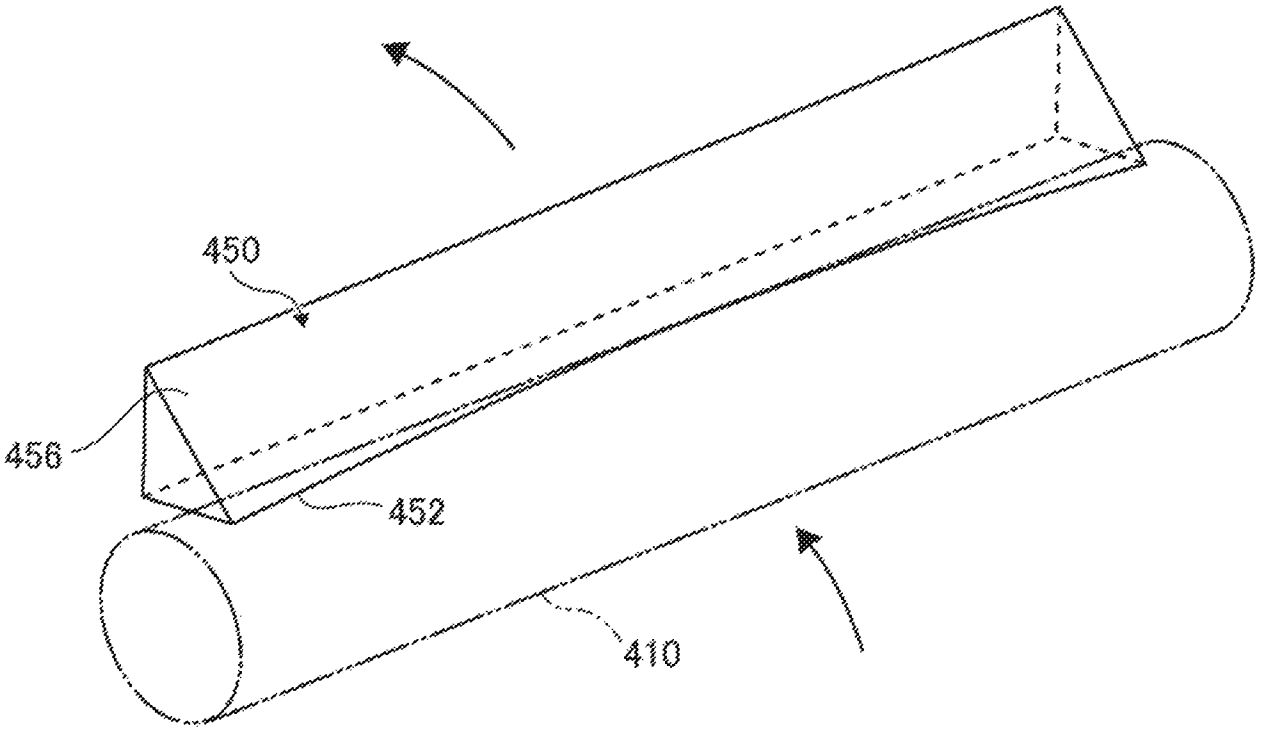
FIG. 7 illustrates a first modification of the guide portion.

FIG. 7 schematically illustrates a first modification of the guide portion 450. The guide portion 450 discussed earlier is formed from the plate-like portion 460 and the plurality of rib portions 470. In contrast, the guide portion 450 according to the first modification is formed from a three-dimensional body in the shape of a generally triangular column that includes an inclined surface 456. The inclined surface 456 is an example of a guide surface, and guides the recording medium P. The inclined surface 456 is continuous with no gap in a direction that crosses the direction in which the recording medium P is transported indicated by the arrows in FIG. 7.

Figure 8:
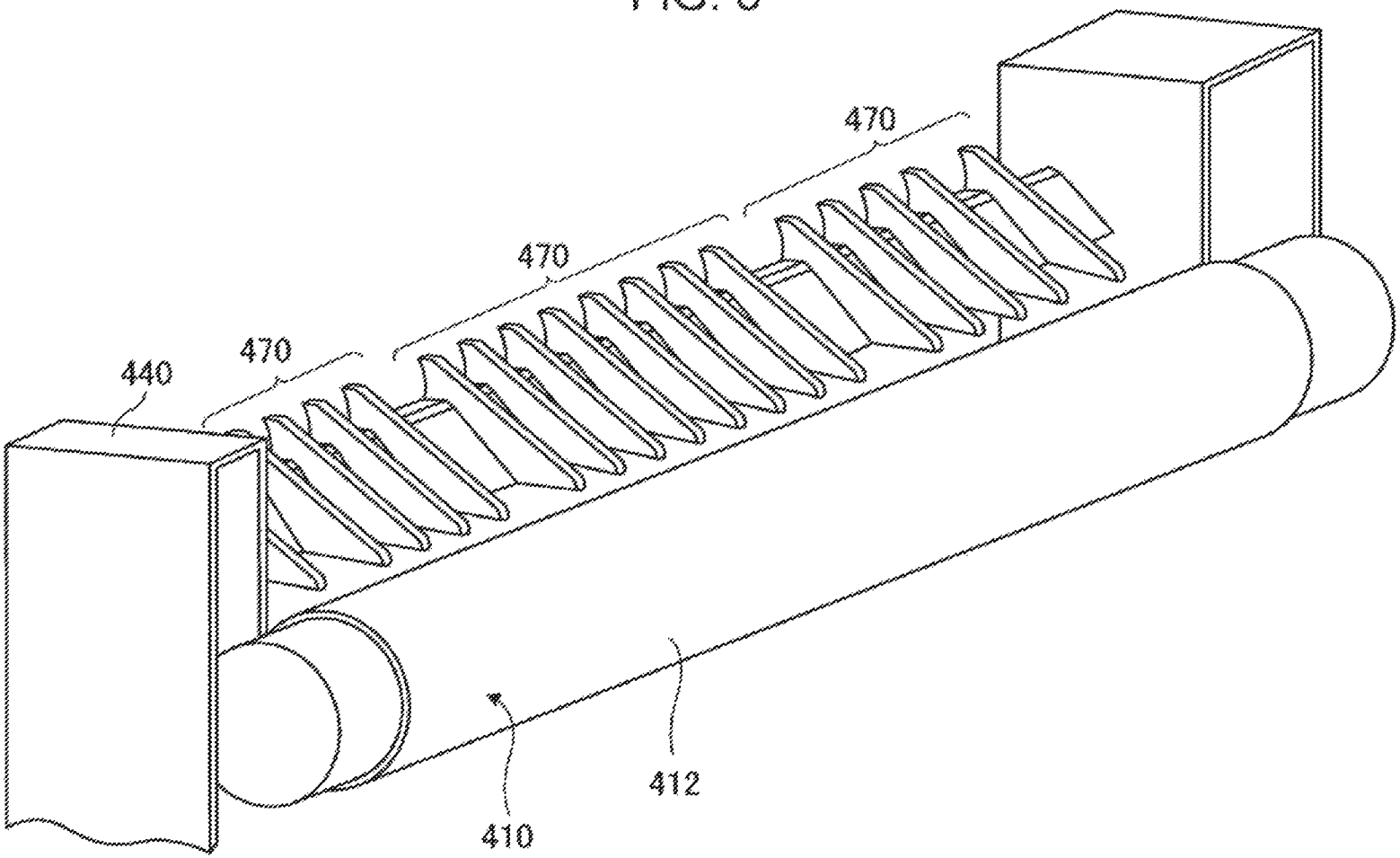
FIG. 8 illustrates a second modification of the guide portion.

FIG. 8 schematically illustrates a second modification of the guide portion 450. The guide portion 450 discussed earlier is formed from the plate-like portion 460 and the plurality of rib portions 470. In contrast, the guide portion 450 according to the second modification does not include the plate-like portion 460, but includes a plurality of rib portions 470 connected to each other.

Also in the first modification and the second modification discussed above, the distance L1 from the exit N2 of the contact portion N to the distal end portion 452 of the guide portion 450 differs in accordance with the position in the longitudinal direction of the heating roller 410 such that the distance L1 at a position at which the pressure between the heating roller 410 and the belt member 430 is low is longer than the distance L1 at a position at which the pressure between the heating roller 410 and the belt member 430 is high.

Also in the first modification and the second modification discussed above, the distance L1 from the exit N2 of the contact portion N to the distal end portion 452 of the guide portion 450 is set such that the distance L1 at a position that is close to the center c of the heating roller 410 and the belt member 430 is longer than the distance L1 at a position that is far from the center c of the heating roller 410 and the belt member 430.

The foregoing description of the exemplary embodiment of the present disclosure has been provided for the purposes of illustration and description. It is not intended to be exhaustive or to limit the disclosure to the precise forms disclosed. Obviously, many modifications and variations will be apparent to practitioners skilled in the art. The embodiment was chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A fixing device comprising:

a heating member that heats a toner image, at least a surface of the heating member including an elastic body;

a pressing member that presses a recording medium against the heating member; and a guide portion that is in no contact with the heating member and that guides the recording medium, which has been ejected from a contact portion at which the heating member and the pressing member contact each other, toward a downstream side in a moving direction of the recording medium, wherein a distance from an exit of the contact portion to an end portion of the guide portion on a side of the exit of the contact portion differs in accordance with a position in a longitudinal direction of the heating member, and the distance at a position at which a pressure between the heating member and the pressing member is low is longer than the distance at a position at which the pressure between the heating member and the pressing member is high, wherein the guide portion is disposed on a same side of the recording medium as the heating member, wherein the distance from the end portion of the guide portion on the side of the exit of the contact portion to the surface of the heating member is constant even at different positions in the longitudinal direction of the heating member.

2. The fixing device according to claim 1, wherein a difference in a distance between the end portion of the guide portion adjacent the exit of the contact portion and the surface of the heating member among adjacent positions in the longitudinal direction of the heating member is smaller than a difference in the distance between the exit of the contact portion and the end portion of the guide portion adjacent the exit of the contact portion among the adjacent positions in the longitudinal direction of the heating member.

3. The fixing device according to claim 2, further comprising:

a transport member disposed on a downstream side with respect to the guide portion in a transport direction of the recording medium, the transport member transporting the recording medium which has been guided by the guide portion, wherein a difference in a distance between an end portion of the guide portion adjacent the transport member and the transport member among adjacent positions in the longitudinal direction of the heating member is smaller than a difference in a distance from an end portion of the guide portion adjacent the contact portion and the transport member among the adjacent positions in the longitudinal direction of the heating member.

4. The fixing device according to claim 3, wherein the distance from the end portion of the guide portion on the side of the transport member to the transport member is constant even at different positions in the longitudinal direction of the heating member.

5. The fixing device according to claim 1, further comprising:

a transport member disposed on a downstream side with respect to the guide portion in a transport direction of the recording medium, the transport member transporting the recording medium which has been guided by the guide portion, wherein a difference in a distance between an end portion of the guide portion adjacent the transport member and the transport member among adjacent positions in the longitudinal direction of the heating member is smaller than a difference in a distance from an end portion of the guide portion adjacent the contact portion and the transport member among the adjacent positions in the longitudinal direction of the heating member.

6. The fixing device according to claim 5, wherein the distance from the end portion of the guide portion on the side of the transport member to the transport member is constant even at different positions in the longitudinal direction of the heating member.

7. An image forming apparatus comprising:

a toner image forming portion that forms a toner image on a surface of a recording medium; and the fixing device according to claim 1.

8. A fixing device comprising:

a heating member that heats a toner image, at least a surface of the heating member including an elastic body;

a pressing member that presses a recording medium against the heating member;

a guide portion that is in no contact with the heating member and that guides the recording medium, which has been ejected from a contact portion at which the heating member and the pressing member contact each other, toward a downstream side in a moving direction of the recording medium; and an urging mechanism that urges at least one of the heating member and the pressing member in a direction in which the heating member and the pressing member approach each other, the urging mechanism being disposed on a side of each of both end portions of the heating member and the pressing member in a longitudinal direction of the heating member, wherein a distance from an exit of the contact portion to an end portion of the guide portion on a side of the exit of the contact portion differs in accordance with a position in the longitudinal direction of the heating member, and the distance at a position that is close to a center of the heating member and the pressing member is longer than the distance at a position that is far from the center of the heating member and the pressing member, wherein the guide portion is disposed on a same side of the recording medium as the heating member, wherein the distance from the end portion of the guide portion on the side of the exit of the contact portion to the surface of the heating member is constant even at different positions in the longitudinal direction of the heating member.

9. The fixing device according to claim 8, wherein a difference in a distance between the end portion of the guide portion adjacent the exit of the contact portion and the surface of the heating member among adjacent positions in the longitudinal direction of the heating member is smaller than a difference in the distance between the exit of the contact portion and the end portion of the guide portion adjacent the exit of the contact portion among the adjacent positions in the longitudinal direction of the heating member.

10. The fixing device according to claim 9, further comprising:

a transport member disposed on a downstream side with respect to the guide portion in a transport direction of the recording medium, the transport member transporting the recording medium which has been guided by the guide portion, wherein a difference in a distance between an end portion of the guide portion adjacent the transport member and the transport member among adjacent positions in the longitudinal direction of the heating member is smaller than a difference in a distance from an end portion of the guide portion adjacent the contact portion and the transport member among the adjacent positions in the longitudinal direction of the heating member.

11. The fixing device according to claim 10, wherein the distance from the end portion of the guide portion on the side of the transport member to the transport member is constant even at different positions in the longitudinal direction of the heating member.

12. The fixing device according to claim 8, further comprising:

a transport member disposed on a downstream side with respect to the guide portion in a transport direction of the recording medium, the transport member transporting the recording medium which has been guided by the guide portion, wherein a difference in a distance between an end portion of the guide portion adjacent the transport member and the transport member among adjacent positions in the longitudinal direction of the heating member is smaller than a difference in a distance from an end portion of the guide portion adjacent the contact portion and the transport member among the adjacent positions in the longitudinal direction of the heating member.

13. The fixing device according to claim 12, wherein the distance from the end portion of the guide portion on the side of the transport member to the transport member is constant even at different positions in the longitudinal direction of the heating member.

* * * * *